US007971402B2

(12) United States Patent
Engberg

(10) Patent No.: US 7,971,402 B2
(45) Date of Patent: Jul. 5, 2011

(54) CEILING STRUCTURE FOR COMMERCIAL KITCHENS

(76) Inventor: Shawn Engberg, Kearney, NE (US)

( * ) Notice: Subject to any disclaimer, the term of this patent is extended or adjusted under 35 U.S.C. 154(b) by 0 days.

(21) Appl. No.: 12/389,943

(22) Filed: Feb. 20, 2009

(65) Prior Publication Data

US 2009/0211189 A1 Aug. 27, 2009

Related U.S. Application Data

(60) Provisional application No. 61/066,839, filed on Feb. 22, 2008.

(51) Int. Cl.
*E04C 1/00* (2006.01)

(52) U.S. Cl. ..... 52/309.3; 52/309.1; 52/506.06

(58) Field of Classification Search ..... 52/309.3, 52/309.1, 506.06
See application file for complete search history.

(56) References Cited

U.S. PATENT DOCUMENTS

| | | | | |
|---|---|---|---|---|
| 3,665,543 | A * | 5/1972 | Nappi | 15/215 |
| 4,471,212 | A * | 9/1984 | Hager, Jr. | 392/435 |
| 4,642,951 | A * | 2/1987 | Mortimer | 52/145 |
| 4,713,274 | A * | 12/1987 | Minor | 428/40.1 |
| 4,837,062 | A * | 6/1989 | Dunshee et al. | 428/41.3 |
| 5,050,360 | A * | 9/1991 | Gailey | 52/506.06 |
| 6,305,495 | B1 * | 10/2001 | Keegan | 181/290 |
| 6,537,717 | B1 * | 3/2003 | Gao et al. | 430/138 |
| 2004/0170793 | A1 * | 9/2004 | Linden et al. | 428/40.1 |
| 2004/0261208 | A1 * | 12/2004 | McKay | 15/215 |
| 2006/0110582 | A1 * | 5/2006 | Dohmers et al. | 428/192 |
| 2007/0020424 | A1 * | 1/2007 | Gruenbacher et al. | 428/40.1 |
| 2007/0020432 | A1 * | 1/2007 | Gruenbacher et al. | 428/136 |
| 2007/0020433 | A1 * | 1/2007 | Gruenbacher et al. | 428/137 |

* cited by examiner

*Primary Examiner* — Richard E Chilcot
*Assistant Examiner* — Mark R Wendell
(74) *Attorney, Agent, or Firm* — Harness, Dickey & Pierce, P.L.C.

(57) ABSTRACT

A stack of a plurality of thin film adhesively bonded members are removably coupled to a ceiling. The adhesive is configured to allow an exposed layer to be removed without removing the entire stack of square members.

19 Claims, 3 Drawing Sheets

CEILING STRUCTURE FOR COMMERCIAL KITCHENS

CROSS-REFERENCE TO RELATED APPLICATIONS

This application claims the benefit of U.S. Provisional Application No. 61/066,839, filed on Feb. 22, 2008. The entire disclosure of the above application is incorporated herein by reference.

FIELD

The present disclosure relates to a ceiling structure and, more particularly, to a structure and method of cleaning a ceiling surface in a kitchen environment.

BACKGROUND

The statements in this section merely provide background information related to the present disclosure and may not constitute prior art. Recent restaurant designs utilize open kitchens visibly coupled to the restaurant serving area. Because of this, cleanliness, while always a priority, is a primary concern.

In commercial kitchens, the number of meals prepared lead to significant amounts of oil and food materials to be expressed in the form of steam and vapor into the kitchen environment. Materials carried by these vapors often collect on the interior surfaces of the kitchen. Included in these surfaces is the ceiling which must be cleaned at least monthly. This regular cleaning is expensive and time consuming. In the case of ceiling tiles, it may not be possible to clean the surfaces to an acceptable level, requiring the replacement of the tiles.

SUMMARY

This section provides a general summary of the disclosure, and is not a comprehensive disclosure of its full scope or all of its features.

To assist in the cleaning of the ceiling of the kitchen, a ceiling structure and method of cleaning a kitchen ceiling are provided. In this regard, a ceiling formed of ceiling tiles which are covered with stacks of peel-able polymer layers is provided. To clean the surface, an exposed layer of peel-able polymer material is removed, thus leaving a clean polymer surface.

In one embodiment of the invention, a stack of a plurality of square members are removably coupled to the ceiling. The stack of square members is coupled together using an adhesive. The adhesive is configured to allow an exposed layer to be removed without removing the entire stack of square members.

In another embodiment, a stack of polymer members are coupled together using an adhesive with a holding strength between 24 oz/in and 45 oz/in. The polymer layer, which is coupled to a ceiling surface, has a thickness of less than about 2 mm.

In yet another embodiment, the ceiling structure is provided having a support structure. Coupled to the support structure is a plurality of ceiling tiles; coupled to a plurality of ceiling tiles is a stack of a plurality of mylar sheets, each sheet can be releasably coupled to at least one other sheet with an adhesive. The adhesive material is configured to allow the removal of a single layer of mylar from the stack of mylar sheets.

In another embodiment, a method of cleaning a surface in a kitchen is provided. The method includes the step of coupling a stack of polymer sheets to a surface. After a predetermined amount of time, or upon a predetermined accumulation of material, at least one layer from the stack of polymer sheets is removed.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
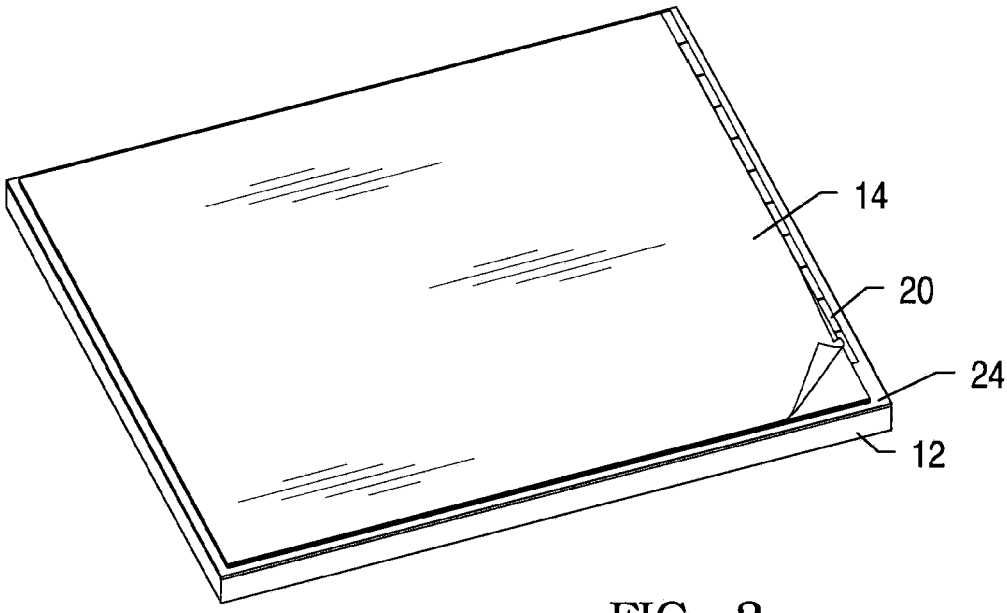
FIG. 2 represents a perspective view of the stack of polymer covers used in the construction of FIG. 1.
Figure 3:
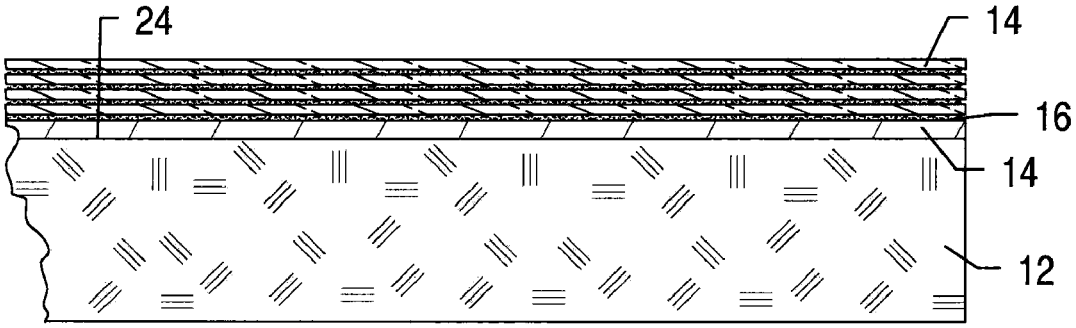
FIG. 3 is a side view of the polymer sheet according to another embodiment which is usable in the ceiling structure shown in FIG. 1.
Figure 5:
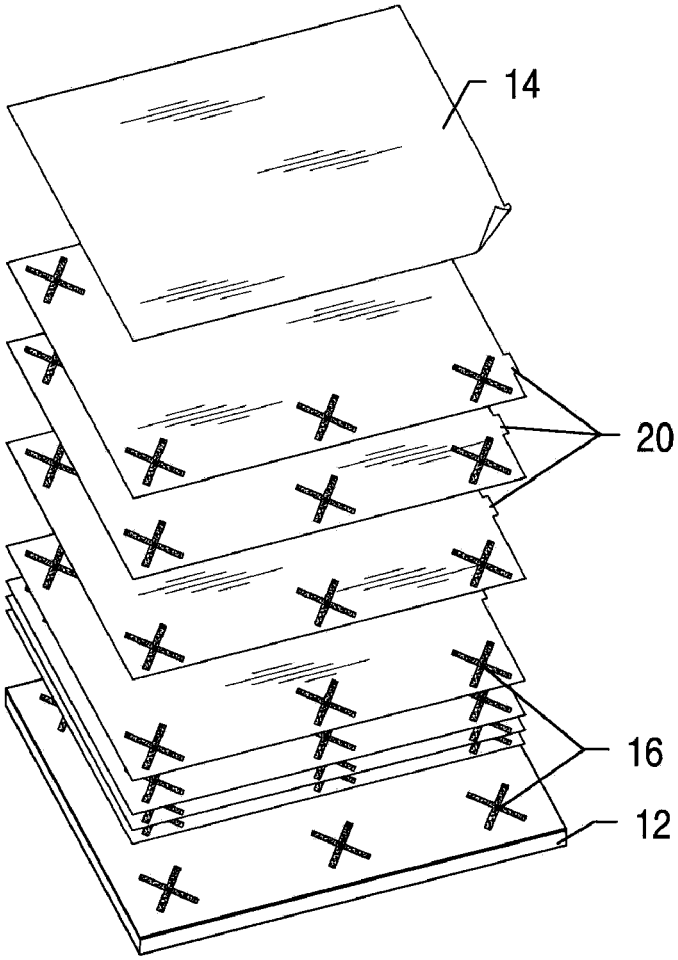
Figure 4A:
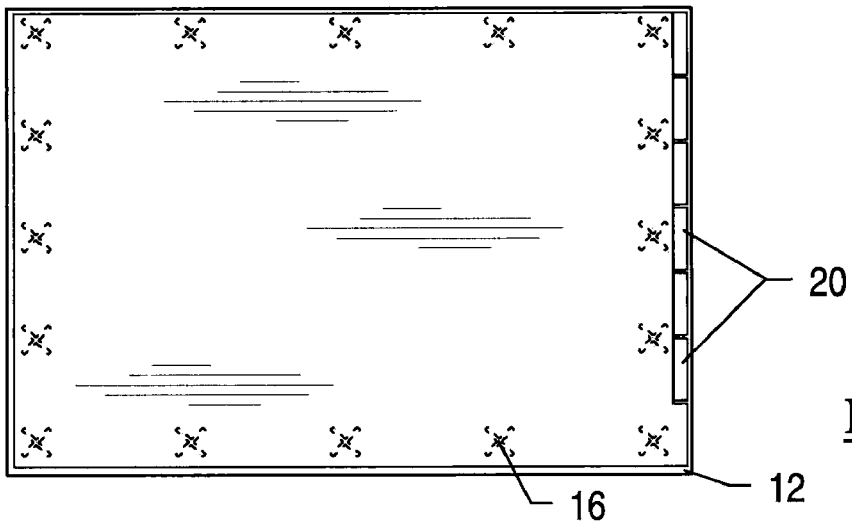
Figure 4B:
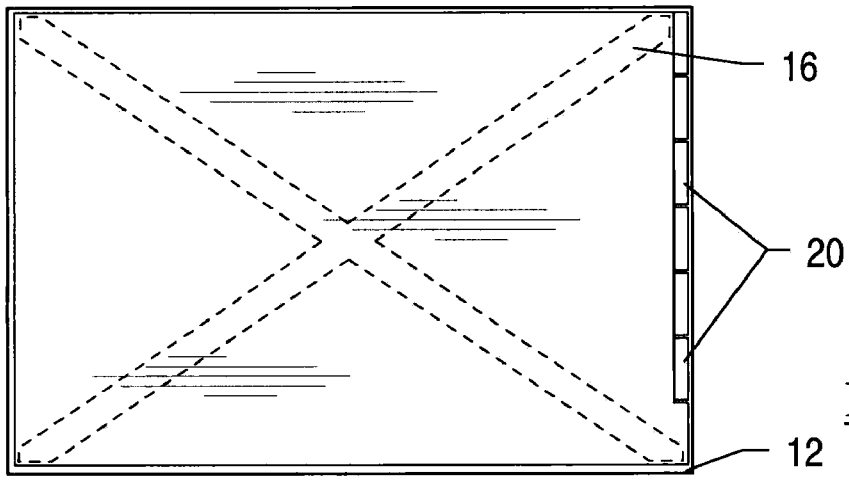
Figure 4C:
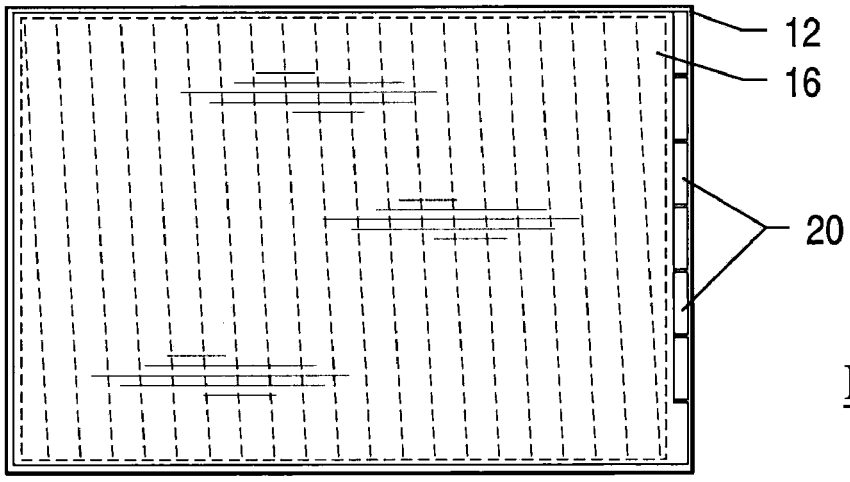

FIGS. 4*a*-4*c* represent top views of the assembly shown in FIG. 2; and FIG. 5 is an exploded view of the stack of polymer layers shown in FIG. 3A.

Corresponding reference numerals indicate corresponding parts throughout the several views of the drawings.

DETAILED DESCRIPTION

Example embodiments will now be described more fully with reference to the accompanying drawings.

Figure 1:
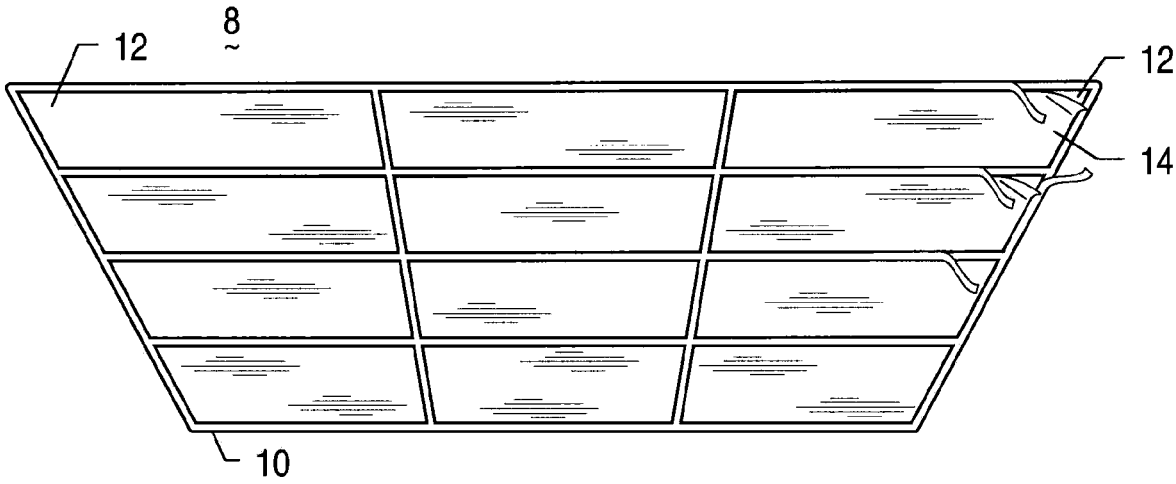
FIG. 1 represents a view of a ceiling structure according to the teaching of the present disclosure.

FIG. 1 represents a perspective view of a ceiling structure 8 according to the teaching of the present disclosure. Shown is a support structure or frame 10 which supports a plurality of ceiling tiles 12. These ceiling tiles 12, can be square or rectangular and, preferably, have a smooth surface texture. Additionally, the frame 10 can also have strips of layers of polymer applied thereto.

Disposed on the ceiling tiles 12 is a stack of polymer sheets 14. The sheets 14, (see FIG. 2), are coupled together with adhesive 16 in a manner which allows the removal of a single layer of the polymer sheets 14. It is envisioned the adhesive 16 can be disposed between the layers at the periphery 18 of the polymer sheets 14. The adhesive material can be from 0.5 to 2.5, and, preferably, 2.0 mils thick. This adhesive can be configured to allow the top sheet to be selectively removed from the stack of sheets with the application of between about 45 oz/in and 24 oz/in of force. The adhesive is configured to resist delamination caused by gravity under a temperature up to about 400° F. Similarly, the adhesive is configured to resist delamination caused by gravity and humidity of up to about 100% humidity.

As shown in FIGS. 2 and 4*a*-4*b*, the stack of polymer sheets 14 each can have a pull-able tab 20 to facilitate the removal of the polymer sheets 14. These pull-able tabs 20 can be overlapping or can be staggered to allow access to the tabs when the stack of polymer sheets are coupled to the ceiling tile. It is preferable that more than (90%) of the adhesive be attached to the removed sheet of polymer material 14.

As best seen in FIG. 3, the ceiling tile 12 has a stack of polymer sheets 14. In the preferred configuration, approximately twelve polymer sheets are applied to a visible surface 24 of the ceiling tile 12.

The polymer and adhesive preferably are formed of fire resistant material. In this regard, the polymer material is preferably formed of mylar or acrylic from coating and converting technologies. Optionally, the film can be formed of biodegradable material. In this regard, it is envisioned the biodegradable material can be a bi-phase material containing a plasticizer, a lubricant, and a thermal stabilizer. These layers can have a pattern or color imprinted therein or thereon to camouflage the presence of dirt or grease.

The material for the polymer film is between 0.5 and 2 mm thick and preferably between 0.5 and 1 mm thick. As best can be seen in FIGS. 4*a*-4*c*, the adhesive 16 can be distributed over the polymer sheets using varying configurations. In this regard, the adhesive 16 can be formed in x patterns around the periphery 18 of the polymer sheet 14. Additionally, the adhesive can be distributed across the sheet in an x pattern or in stripes or strips over the entire sheet.

The stack of polymer sheets can weigh less than 5 ounces. The stack of polymer sheets can also be coupled either to the support structure or the ceiling tiles. To prepare a surface for cleaning under the present teachings, a stack of polymer layers are coupled to a ceiling structure. After a desired or predetermined amount of time or the accumulation of an undesirable amount of material, the outermost polymer layer can be removed from the stack of polymer layers.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A ceiling structure comprising:

a support structure;

a plurality of ceiling tiles;

a stack of peel-able polymer sheets coupled to a ceiling tile providing an outermost sheet having an exposed polymer surface; and adhesive disposed between the polymer sheets, wherein removal of the outermost sheet from the stack includes removal of more than 90% of the adhesive disposed between the removed outermost sheet and an adjacent polymer sheet.

2. The ceiling structure according to claim 1 wherein the polymer sheets comprise mylar.

3. The ceiling structure according a claim 2 wherein the mylar sheet has a thickness of between 0.5 mm and 2 mm.

4. The ceiling structure according to claim 1 wherein the stack of polymer sheets is coupled to a plurality of ceiling tiles.

5. The ceiling structure according to claim 1 wherein the stack of polymer sheets is coupled to the support structure.

6. A ceiling structure consisting essentially of:

a support structure;

a ceiling layer coupled to the support structure;

a stack of peel-able polymer sheets coupled to the ceiling layer, each sheet having a thickness of between 0.5 mm and 2 mm, wherein an outermost sheet of the stack provides an exposed polymer surface; and adhesive disposed between layers of sheets in the stack of polymer sheets wherein removal of the outermost sheet includes removal of more than 90% of the adhesive disposed between the removed outermost sheet and an adjacent sheet.

7. The ceiling structure according to claim 6 wherein the ceiling layer is a ceiling tile.

8. The ceiling structure according to claim 6 wherein the stack of polymer sheets is formed of mylar.

9. The ceiling structure according to claim 8 wherein each of the polymer sheets comprises a tab.

10. The ceiling structure according to claim 9 wherein the adhesive layer is disposed about the periphery of the polymer layer.

11. The ceiling structure according to claim 9 wherein the adhesive layer is evenly disposed over a portion of the polymer sheets.

12. The ceiling structure according to claim 9 wherein the adhesive layer is formed in stripes.

13. A ceiling structure comprising:

a support structure;

a ceiling tile coupled to the support structure; and a stack of thin film peel-able polymer material layers coupled to the ceiling tile, wherein an outermost layer of the stack provides an exposed polymer surface; and a layer of adhesive between the thin film polymer material layers, wherein the stack of polymer materials are formed with a holding strength between 24 oz/in and 45 oz/in, and further wherein removal of the outermost layer includes removal of more than 90% of the adhesive layer disposed between the removed outermost layer and an adjacent layer.

14. The ceiling structure according to claim 13 wherein the stack of thin film polymer material layers comprise a plurality of polymer sheets, each less than 2 mm thick.

15. The ceiling structure according to claim 14 wherein each of the polymer sheets comprises a tab.

16. The ceiling structure according to claim 14 further comprising an adhesive layer disposed around the periphery of the polymer sheets.

17. The ceiling structure according to claim 1 wherein the polymer sheets are formed of biodegradable material.

18. The ceiling structure according to claim 7 wherein the biodegradable material comprises a bi-phase material including a plasticizer, a lubricant, and a thermal stabilizer.

19. The ceiling structure according to claim 6 wherein the stack of polymer sheets is formed with a holding strength between 24 oz/in and 45 oz/in.

* * * * *